US006550660B1

(12) United States Patent
Chlebowski et al.

(10) Patent No.: US 6,550,660 B1
(45) Date of Patent: Apr. 22, 2003

(54) HAMMER-TYPE STAPLER WITH TAB FEEDER

(76) Inventors: Edmund M. Chlebowski, 433 Bayshore Dr., Wilmington, NC (US) 28411; Brian Malcolm Swanson, 308 Harlandale Dr., Wilmington, NC (US) 28411

( * ) Notice: Subject to any disclaimer, the term of this patent is extended or adjusted under 35 U.S.C. 154(b) by 26 days.

(21) Appl. No.: 09/922,466

(22) Filed: Aug. 3, 2001

(51) Int. Cl.[7] ..... B27F 7/32

(52) U.S. Cl. ..... 227/133; 227/131; 227/134; 227/138

(58) Field of Search ..... 227/120, 129, 227/133, 134, 136, 138, 140, 147, 15, 18

(56) References Cited

U.S. PATENT DOCUMENTS

| | | | | | |
|---|---|---|---|---|---|
| 2,432,853 | A | * | 12/1947 | Barclay | 227/133 |
| 2,537,601 | A | * | 1/1951 | Peterson | 227/133 |
| 2,645,773 | A | * | 7/1953 | Dugin | 227/133 |
| 2,653,317 | A | * | 9/1953 | Beckman et al. | 227/86 |
| 2,661,999 | A | * | 12/1953 | Abrams | 227/133 |
| 2,664,565 | A | * | 1/1954 | Percoco | 227/120 |
| 2,896,210 | A | * | 7/1959 | Rubin | 227/133 |
| 4,033,499 | A | | 7/1977 | Butler | |
| 4,036,422 | A | | 7/1977 | Harvey | |
| 4,182,474 | A | | 1/1980 | Sato | |
| 4,455,804 | A | | 6/1984 | Francovitch | |
| 4,657,167 | A | | 4/1987 | Mays | |
| 4,780,039 | A | | 10/1988 | Hartman | |
| 4,870,750 | A | | 10/1989 | Zahn | |
| 5,042,142 | A | | 8/1991 | Beach et al. | |
| 5,193,729 | A | | 3/1993 | Dewey et al. | |
| 5,292,048 | A | | 3/1994 | Vanderwiel | |
| 5,407,313 | A | | 4/1995 | Bruins et al. | |
| 5,484,094 | A | | 1/1996 | Gupta | |
| 5,634,583 | A | | 6/1997 | McGuinness et al. | |
| 5,947,362 | A | * | 9/1999 | Omil | 227/120 |
| 5,975,401 | A | | 11/1999 | Fealey | |
| 6,012,623 | A | * | 1/2000 | Fealey | 227/134 |

* cited by examiner

*Primary Examiner*—Scott A. Smith
*Assistant Examiner*—Chukwurah Nathaniel
(74) *Attorney, Agent, or Firm*—MacCord Mason PLLC

(57) ABSTRACT

A manually operated hammer-type stapler for attaching a material to a surface with a tabbed staple includes a staple driver having a staple drive blade moveable along a blade pathway between a raised position to a lowered position; a striker at the distal end of the stapler; an elongated handle extending rearwardly from the staple driver; an elongated staple magazine beneath and parallel to the handle, the staple magazine having a discharge end adjacent the blade pathway to position a staple beneath the driver blade; and an elongated tab magazine parallel to and beneath the staple magazine, the tab magazine having a discharge end adjacent the blade pathway to position a tab beneath the driver blade, whereby the driver blade moves from its raised position to its lowered position when the striker is impacted against the surface to drive a staple through a tab and into the surface.

14 Claims, 6 Drawing Sheets

HAMMER-TYPE STAPLER WITH TAB FEEDER

BACKGROUND OF THE INVENTION (1) Field of the Invention

The present invention relates generally to an apparatus for driving staples through tabs for securing sheet material to a substrate. In particular, the invention is well suited for efficiently securing roof felt to the roof of a structure.

(2) Decsription of the Prior Art

The conventional method of attaching roofing felt to a roof is to use a large headed fastener commonly referred to as a felt nail or "button cap". A popular type of felt nail has a plastic disc for a head through which a brad or nail has been factory pre-positioned. The plastic disc head is circular and concave towards the roof surface. A roofer carries a supply of felt nails in a nail apron. After roof felt has been positioned and the roofer is ready to fasten the felt to the roof, he or she holds the roofing nail erect with two fingers beneath the plastic disc head. Normally, the roofer sets the felt nail with one blow of the hammer then drives the felt nail to its final seated position with a second blow.

To prevent foot injuries, manufacturers of plastic disc type felt nails do not rigidly fix the nail portion within the plastic disc. This allows the nail to deflect away and not penetrate the shoe of someone who accidentally steps on the nail. Unfortunately, since the plastic disc does not rigidly hold the nail or brad, the setting blow often results in a bent nail and perhaps injured fingers. Bent felt nails are often discarded, resulting in many fasteners being carelessly tossed about.

Considering the wasted time and wasted felt nails littering the ground around roofed structures, it is not surprising that attempts to improve the roof felt attaching process are ongoing. In recent years, electric or pneumatic staple and nail guns have been adapted for the roofing process.

One such staple or nail gun is described in U.S. Pat. No. 5,184,752 to Zylka et al. Zylka et al. describes a method and apparatus for feeding tabs or discs to an automatic staple or nail gun for the purpose of attaching roof felt to the substrate of a roof. The Zylka et al. apparatus is comprised of a commercially available pneumatic nail gun, with an upright canister to contain plastic discs that are forced downward by a spring. A carriage is positioned underneath the canister to shuttle one disc at a time from the canister to below the nails being driven. Upon actuation of the nail gun's triggering mechanism, a nail is expelled with force penetrating a disc, roof felt and roof substrate.

Unfortunately, electric and pneumatic nail guns are expensive, heavy, bulky and usually encumbered with a lengthy power cord or pneumatic hose. Worse still, power cords and\or pneumatic hoses strewn across a roof become dangerous tripping hazards to workers on a roof. What is needed is an apparatus suitable for efficiently, safely and economically attaching roof felt to a roof.

SUMMARY OF THE INVENTION

The present invention addresses this need by providing a modified manual hammer-type stapler that is particularly well suited for securely attaching roof felt to a roof.

Hammer-type staplers are well known in the prior art, and are generally comprised of a staple delivery head and staple magazine attached to a handle. All hammer-type staplers generally fall into one of two categories. In the first category, a staple driver element is fixed to the staple delivery head and handle, with the staple magazine moving upward to meet the fixed staple driver element upon impact. In the second category, the staple delivery head and staple magazine are fixed. A staple is driven when the staple driver element is moved downward along a path to meet the lead staple from a magazine in response to impact.

The present invention includes modifications of a hammer-type stapler that falls within this second category. U.S. Pat. No. 2,896,210 to Rubin discloses an example of a second category stapler that can be suitably modified for use in the present invention. The Rubin patent discloses a hammer-type stapler having a staple magazine with a channel pathway that holds a strip of aligned, adjacent staples, along with a staple positioner that urges the staple strip to a discharge end of the magazine. A driver blade forces the leading staple of the strip through a staple exit when a striker connected to the driver blade by levers impacts a solid yet penetrable surface.

Roofers use hammer-type staplers to fasten roof felt onto a roof by impacting the roof felt stretched across the roof substrate with a hammer-like blow that drives the sharp pointed legs of a staple through the roof felt and into a roof substrate, usually made of wood. However, the use of staples alone as roof felt fasteners is adequate only in calm wind conditions. During windy conditions, roof felt has a tendency to rip away from the roof substrate leaving the staple behind.

A staple by itself does not have enough surface area to reliably hold fast the roof felt in breezy conditions. Waiting for calm wind conditions is not a viable option for roofers in an economic sense.

One known way of improving a staple's fastening effectiveness is to increase the staple's effective holding area by first driving the staple through a narrow strip of high tensile strength sheet material such as plastic or metal. Preferably, the sheet material is made from polystyrene plastic. Other suitable plastics include but are not limited to: Nylon, Lexan, acrylics, and polycarbonates.

This narrow strip of plastic or metal, commonly referred to as a tab, has substantially more surface area in contact with stapled material than a staple would alone. Consequently, a staple used in conjunction with a tab is significantly more effective as a fastener, so much more, that roof felt can be attached to a roof in wind conditions that would normally render the roof felting process futile. Prior art hammer-type staplers, however, do not include a means for feeding tabs under a stapler's drive blade where tabs can be combined with staples in such a way as to increase the effective fastening capability of the staples.

The present invention addresses this need by providing a hammer-type stapler that includes a tab feeder. When the stapler of the present invention is struck against a roof surface covered by roof felt, a staple is driven into a plastic or metal tab that has an area substantially larger than the stable. With one blow of the hammer stapler, a staple is completely seated into the roof substrate with a tab on top and roof felt sandwiched between the tab and roof substrate. The relatively large area of the tab prevents the roofing felt from tearing away from the roof substrate even in windy conditions.

The hammer-type stapler of the present invention is generally comprised of a staple driver; an elongated handle extending rearwardly from the staple driver; a staple feeder parallel to and beneath the handle to position a staple beneath the staple driver; and a tab feeder parallel to and beneath the staple feeder to position a tab beneath the staple driver, so that a staple driven by the staple driver will penetrate the tab.

The staple driver includes a staple driver blade that is movable along a pathway between a raised and a lowered position, and a striker that is located at the distal end of the stapler and moveable upward when the striker impacts a surface to be stapled. A lever mechanism connects the striker to the driver blade, so that the driver blade moves downward when the striker is impacted against a surface. A return spring is connected to the lever mechanism to return the driver blade to the raised position when the stapler is lifted from the surface.

An elongated handle extends rearwardly from the staple driver for use in swinging the stapler. A grip, such as a molded plastic grip, may form part of the handle.

A staple magazine is positioned beneath, and parallel to, the handle to hold a plurality of staples that are fed sequentially beneath the drive blade of the staple driver. The staple magazine includes a discharge end that is adjacent the driver blade pathway, so that the lead staple is positioned against a stop for engagement by the driver blade as the blade is moved from its raised to its lowered position. A spring urges the staples against the stop.

A tab magazine is positioned beneath and parallel to the staple magazine. The tab magazine also has a discharge end adjacent to the driver blade pathway in order to position a tab beneath the driver blade, so that a staple driven by the driver blade will be driven through the tab before penetrating the surface. The tab magazine further comprises an elongated rectangular housing having a discharge end along with a spring to urge tabs within the housing towards the tab magazine's discharge end. The tab magazine is adapted to move a planar strip of tabs along a tab pathway until the lead tab extends beyond the discharge end of the tab magazine and is stopped by a tab stop, which may be formed by the back edge of the striker.

The tab strip is comprised of a plurality of tabs that are joined to each other by perforations. The tabs preferably have a longitudinal dimension that is approximately equal to the distance between the discharge end of the tab magazine and the stop. Thus, the perforated edge between the leading and immediately trailing tabs will lie along the edge of the tab magazine discharge end, facilitating tearing of the leading tab from the tab strip.

When the striker of the hammer-type stapler impacts a hard yet penetrable surface, the staple driver will be moved from its raised to its lowered position, driving the lead staple through the tab beneath the staple and the surface of the material being stapled to a substrate. The legs of the driven staple continue through the material and sink into the substrate. As the stapler rebounds from impact the stapled tab is torn away from the tab strip along the perforated line. Once the driven staple and separated tab clear their respective magazines, a new staple and a new tab are forced against their respective stops. The tension springs of both the tab and staple magazines are sufficiently forceful to advance the next staple and the next tab quickly enough to be ready for the next staple blow no matter how often the roofer desires to drive a staple.

Consequently, a roofer using the present invention can be just as efficient as a roofer using an electric or pneumatic automatic stapler with tab feeder without having to contend with stringing dangerous power cords or hoses across a roof. Moreover, the hammer-type stapler of the present invention is much lighter, less bulky and less expensive than either electric or pneumatic automatic staple guns. Also, the hammer stapler outperforms the conventional hammer and felt nail method because there is no need for the roofer to manually hold the tab or plastic disc with one hand and hammer with the other. Furthermore, the hammer-type stapler of the present invention requires only one swing versus the conventional methods two.

DETAILED DESCRIPTION OF THE PREFERRED EMBODIMENT

Figure 1:
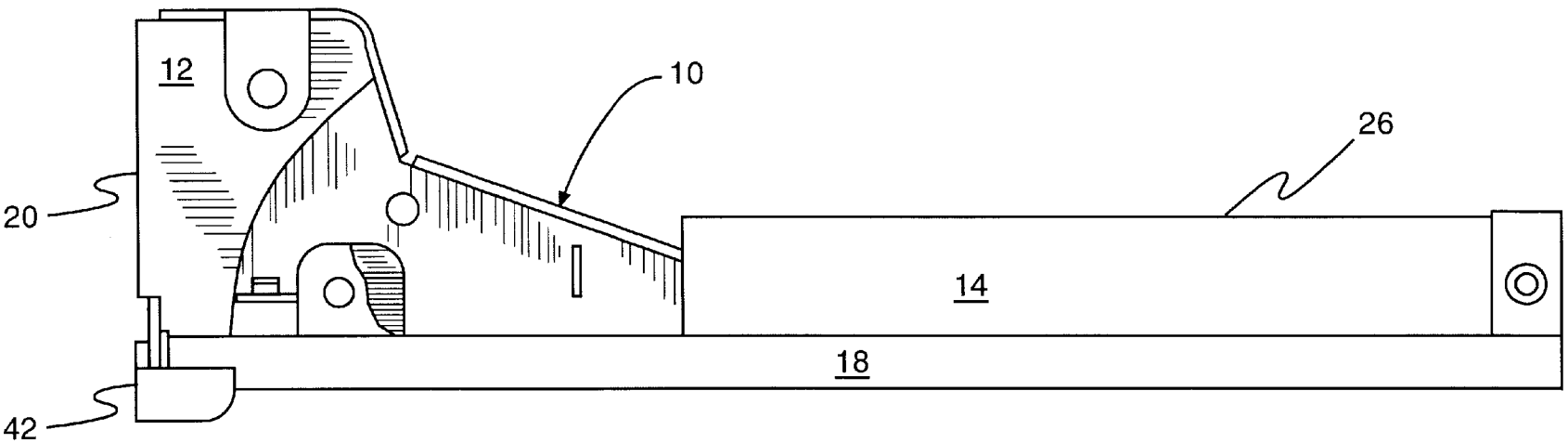
FIG. 1, is a side view of the hammer-type stapler.
Figure 2:
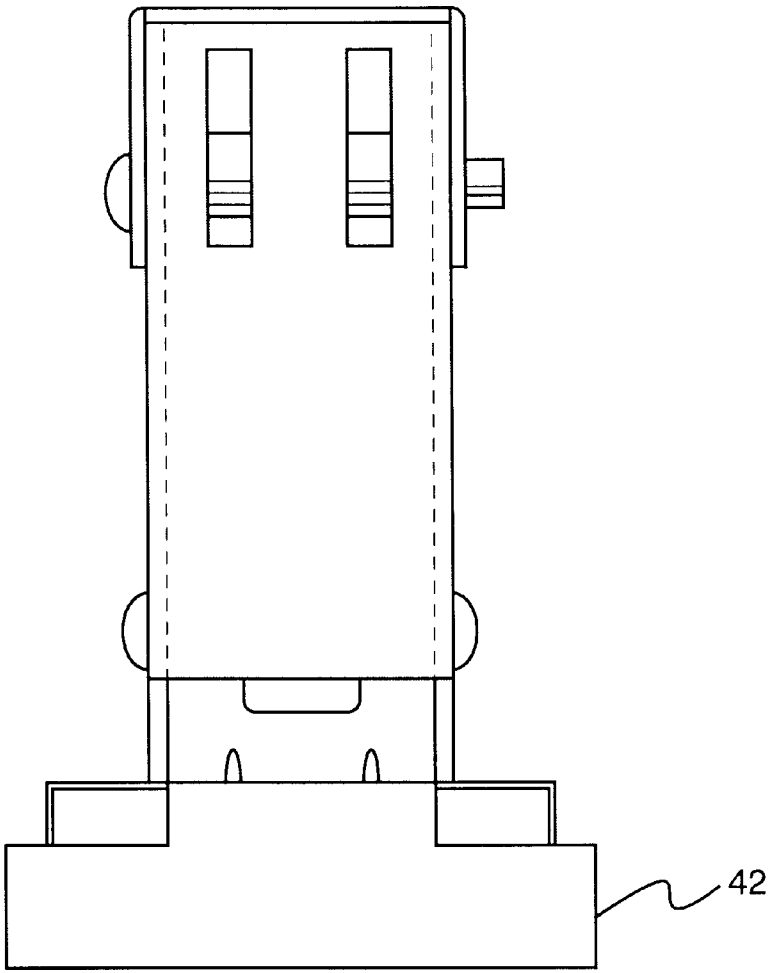
FIG. 2, is a front view of the hammer-type stapler.
Figure 3:
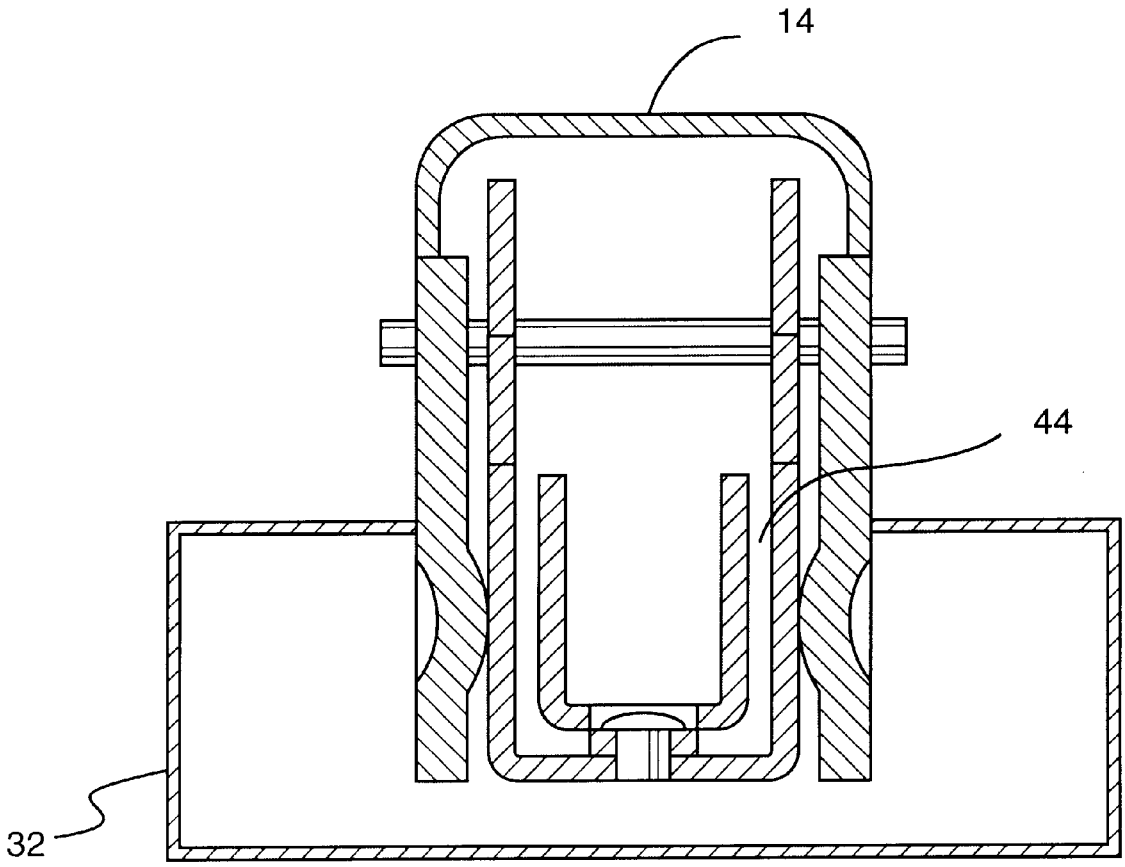
FIG. 3, is an end view of the hammer-type stapler.

In the following description, like reference characters designate like or corresponding parts throughout the views.

Hammer-type stapler, generally 10, is comprised of a staple driver, generally 12, an elongated handle 14 extending rearwardly from driver 12, a staple magazine, generally 44, attached to the lower surface of handle 14, and a tab magazine, generally 34, attached beneath staple magazine 44.

Figure 4:
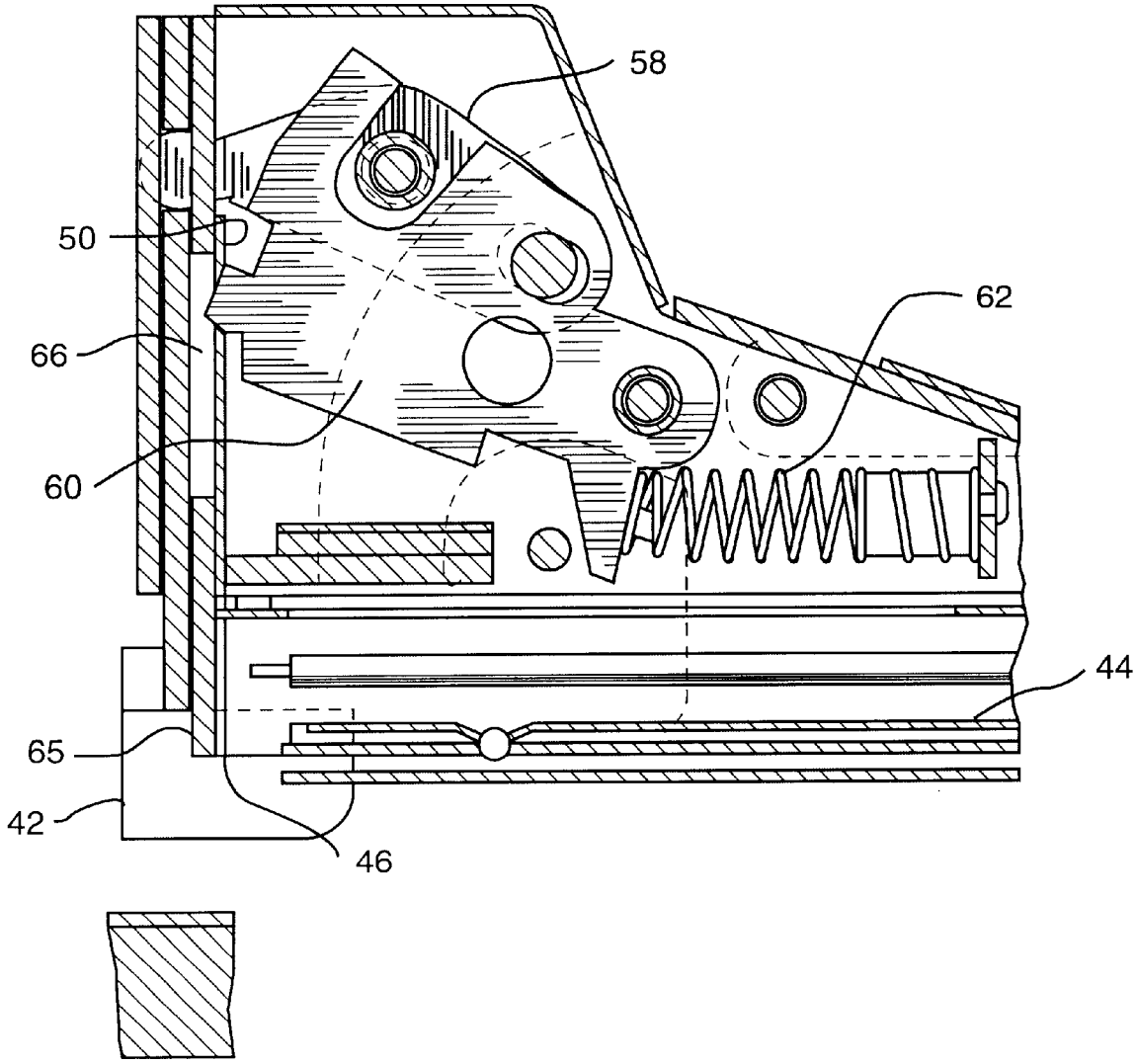
FIG. 4, is a vertical longitudinal partial view of the stapler head prior to impact.
Figure 5A:
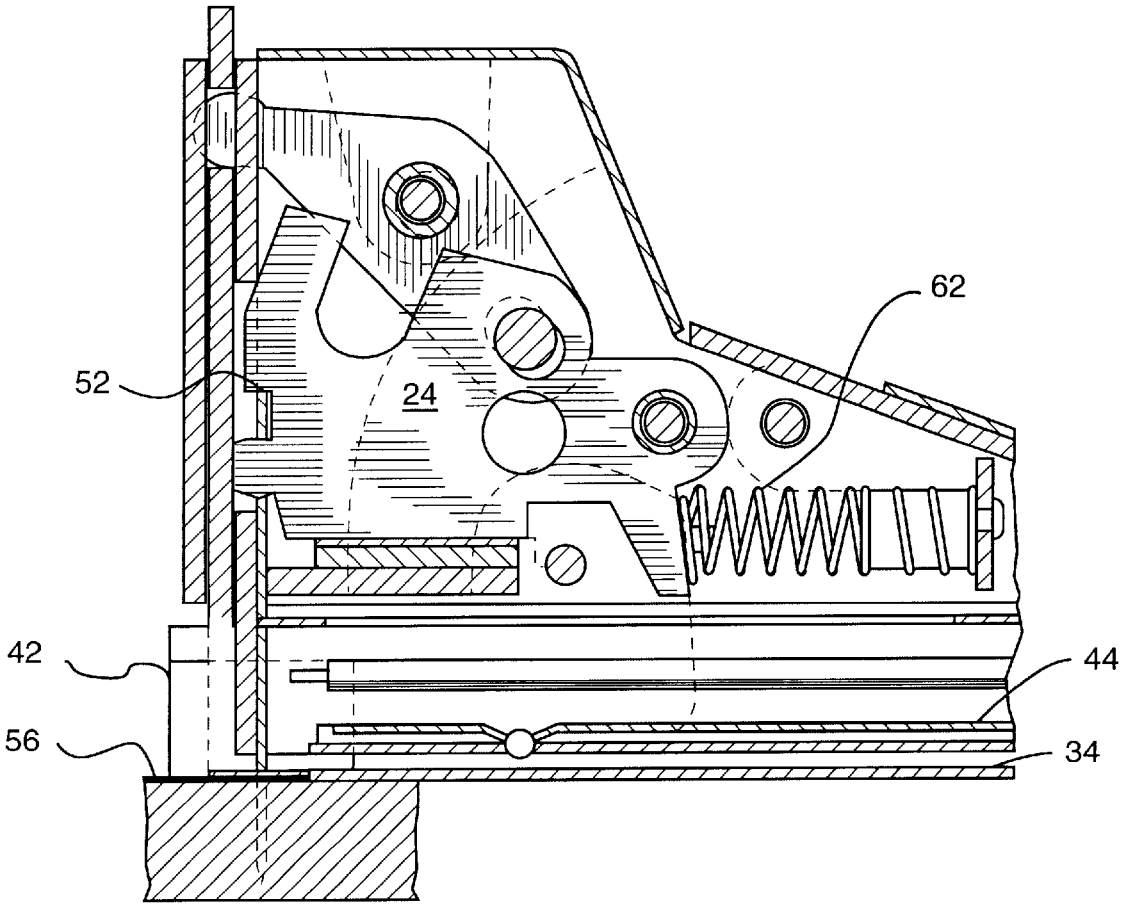
FIG. 5*a*, is a vertical longitudinal partial view of the stapler head at impact.
Figure 5B:
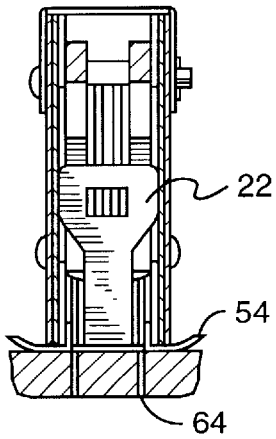
FIG. 5*b*, is a front cut-away view of the stapler's driver blade seating a staple through a tab.
Figure 6:
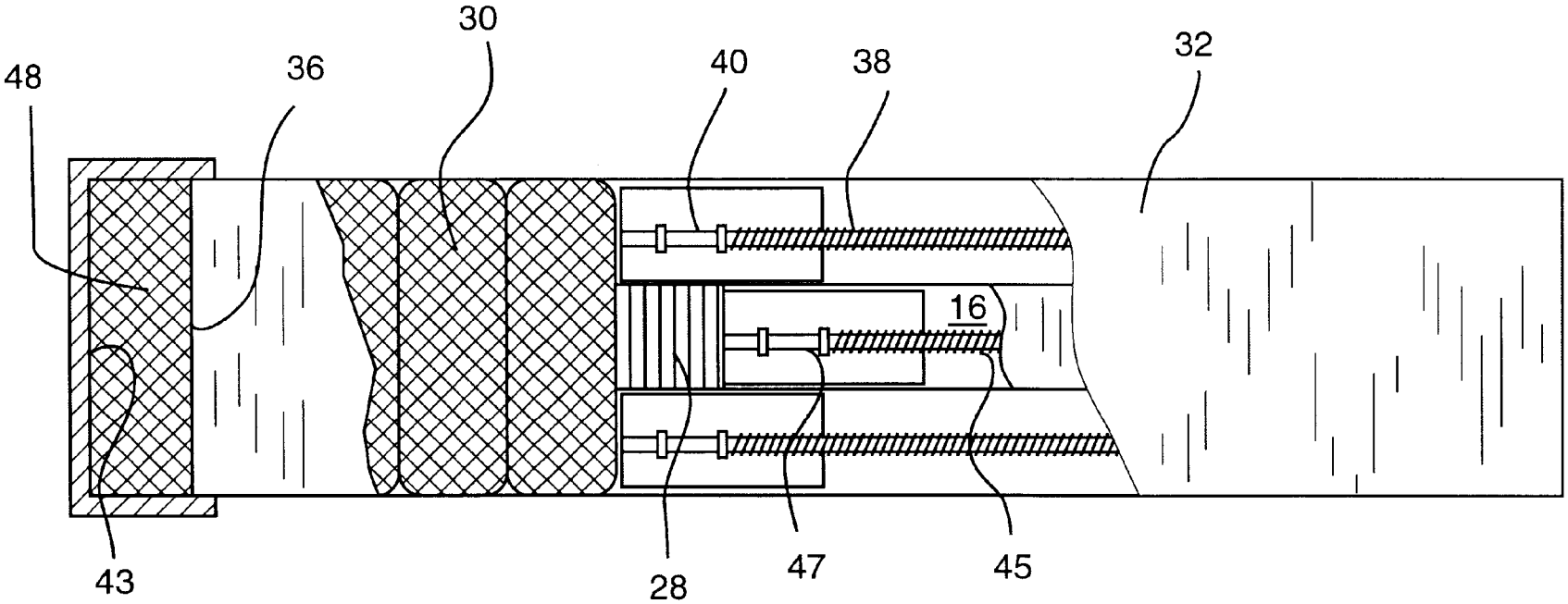
FIG. 6, is a partial cut-away bottom view of the stapler.

Staple driver 12 includes a staple driver blade 22 movable along a pathway between a raised position, as shown in FIG. 4, and lowered position, as shown in FIG. 5*a*. Striker 42 extends downwardly from the distal end of stapler 10 to engage a surface when stapler 10 is swung downwardly. Striker 42 is connected to lever 58, which in turn is attached to arm 60. Arm 60 is attached to drive blade 22, so that upward movement of striker 42 causes blade 22 to move quickly downwardly. Return spring 62 is also compressed as striker 42 is pushed in an upward direction by the impact.

Staple magazine 44, attached beneath handle 14, has a discharge stop 65 adjacent to the pathway of driver blade 22 to position the lead staple of staple strip 28 beneath driver blade 22, for engagement by the lower edge of driver blade 22 as blade 22 moves from its raised position to its lowered position. Staple magazine also includes a tension spring 45 to urge a pusher rod 47 against the rear end of staple strip 28 to move staple strip 28 against staple stop 65.

Tab magazine 34 is adapted to move a planar strip of tabs 30 along a tab pathway until the lead tab is stopped by a tab stop 43 formed by the back edge of striker 48. Tab magazine 34 includes an elongated rectangular housing 32 having a discharge end 36, and a spring 38 to urge tabs 30 within housing 32 towards the tab magazine's discharge end 36. Stop 43 is spaced from the discharge end of tab magazine 34 by a distance equal to the longitudinal dimension of the tab, so that the tab is torn along perforations aligned with the edge of the tab magazine.

In operation, the user grasps stapler handle 14, which includes plastic grip 26, and swings the stapler against the material to be stapled, so that striker 42 impacts against the material. The impact drives striker 42 upwardly, causing blade 22 to move downwardly to push the lead staple of strip 28 through the lead tab of tab strip 30, which is centered by stop 43, and then through the material being stapled and into the surface being covered.

As stapler 10 rebounds, tab 48 is torn from the strip of tabs 30 along a perforated line connecting it to the remainder of strip 30. Tab discharge end 36 forms an edge that is useful for breaking perforated lines holding the individual tabs together in strip 30.

Also, as the stapler rebounds, staple feeder 16 urges a next staple into position. Tab feeder 18 urges a next tab forward against tab stop 43 formed by the back edge of striker 42. At this point stapler 10 is ready to staple again.

It will be obvious to one skilled in the art that many modifications and variations can be made to the present invention without departing from its spirit and scope. Therefore, the invention is not to be limited by the description of the preferred embodiment, but is to be limited only by the scope of the following claims.

What is claimed is:

1. A manually operated hammer-type stapler for attaching a material to a surface comprising:

a) a staple driver having a blade moveable along a pathway between raised and lowered positions;

b) an elongated handle attached to said staple driver;

c) a staple feeder parallel to and beneath said handle to position a staple within said blade pathway; and d) a tab magazine including a tab feeder beneath said staple feeder to position a tab within said blade pathway, wherein said tab magazine includes an elongated rectangular housing having a discharge end, and a spring to urge tabs within said housing toward said discharge end.

2. The stapler of claim 1, wherein said staple driver includes a striker for impacting said surface, and a driver blade actuator connecting said striker to said blade.

3. The stapler of claim 1, wherein said tab feeder includes a tab magazine adapted to hold a planar tab strip parallel to said staple feeder.

4. The stapler of claim 1, wherein said staple feeder includes a staple magazine with a discharge end for holding a strip of staples, and a staple pusher for urging said staple strip towards said discharge end.

5. The stapler of claim 1, wherein said tab feeder is adapted to move a planar tab strip along a tab pathway, said stapler including a tab stop within said pathway.

6. The stapler of claim 1, wherein said tab feeder includes a housing enclosing a tab magazine having a discharge end to hold a planar tab strip, and a tab pusher to urge said tab strip toward said discharge end.

7. A manually operated hammer-type stapler having a distal end for attaching a material to a surface comprising:

a) a staple driver having a staple drive blade moveable along a blade pathway between a raised position to a lowered position;

b) a striker at the distal end of said stapler;

c) an elongated handle extending from said staple driver;

d) an elongated staple magazine beneath and parallel to said handle, said staple magazine having a discharge end adjacent said blade pathway to position a staple beneath said driver blade; and e) an elongated tab magazine parallel to and beneath said staple magazine, said tab magazine having a discharge end adjacent said blade pathway to position a tab beneath said driver blade, whereby said driver blade moves from said raised position to said lowered position when said striker engages said surface to drive a staple through a tab and into said surface, said tab magazine further including a tab pusher, to urge a strip of tabs toward said discharge end, said tab pusher including at least one tension spring and a pusher rod.

8. The stapler of claim 7, further including a drive blade actuator connecting said striker and said drive blade.

9. The driver blade actuator of claim 8, wherein said striker is moveable from a lowered position to a raised position when impacted on said surface, said stapler further including a return spring to return said striker to said lowered position.

10. The stapler of claim 7, wherein said elongated handle includes a plastic grip.

11. The stapler of claim 7, wherein said tab magazine is adapted to move a strip of tabs along a tab pathway, said striker including a stop within said tab pathway.

12. A manually operated hammer-type stapler with a distal end for attaching a material to a surface comprising:

a) a staple driver adjacent said stapler distal end, said driver having a staple drive blade moveable along a blade pathway between a raised position to a lowered position;

b) a striker including a tab stop at the distal end of said stapler and a horizontal bar with a rear face, the rear face of said bar being within a tab pathway and forming said tab stop, said striker being operatively connected to said drive blade;

c) an elongated handle extending from said staple driver;

d) an elongated staple magazine beneath said handle, said staple magazine being adapted to feed a staple strip along a staple pathway transverse to said blade pathway, said staple magazine having a discharge end adjacent said blade pathway to position a staple beneath said driver blade; and e) a tab magazine parallel to and beneath said staple magazine, said tab magazine having at least one tension spring and pusher rod adapted to feed a planar tab strip along a tab pathway transverse to said blade pathway, said tab magazine having a discharge end adjacent said blade pathway to position a tab beneath said driver blade, whereby said driver blade moves from said raised position to said lowered position when said striker impacts said surface to drive a staple through a tab and into said surface.

13. The stapler of claim 12, wherein said striker is attached to said driver blade by a driver blade actuator, said striker blade being moveable from a lowered position to a raised position when impacted on said surface, thereby moving said driver blade from its raised position to its lowered position, said stapler further including a return spring to return said striker to its lowered position when said stapler is raised from said surface.

14. The stapler of claim 12, wherein said tab strip is comprised of a plurality of tabs having a given longitudinal dimension, said tabs being separated by perforations, the distance between said tab stop and said tab magazine discharge end being approximately equal to said given dimension.

* * * * *